US007281635B2

(12) United States Patent
Sommerfeld et al.

(10) Patent No.: US 7,281,635 B2
(45) Date of Patent: Oct. 16, 2007

(54) FRICTION DRAFT GEAR HOUSING HAVING A REMOVABLE END WALL

(75) Inventors: Howard Sommerfeld, Oak Forest, IL (US); Scott Natschke, Kankakee, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 217 days.

(21) Appl. No.: 11/008,011

(22) Filed: Dec. 9, 2004

(65) Prior Publication Data

US 2006/0124572 A1 Jun. 15, 2006

(51) Int. Cl.
*B61G 9/00* (2006.01)

(52) U.S. Cl. ..... 213/7

(58) Field of Classification Search ..... 213/7, 213/8, 31, 32 R, 33, 75 R
See application file for complete search history.

(56) References Cited

U.S. PATENT DOCUMENTS 3,403,790 A 10/1968 Zanow 3,447,693 A * 6/1969 Cardwell ..... 213/22

* cited by examiner

*Primary Examiner*—S. Joseph Morano
*Assistant Examiner*—Robert J. McCarry, Jr.
(74) *Attorney, Agent, or Firm*—James Ray & Assoc.

(57) ABSTRACT

A friction-type draft gear assembly includes a housing having an open front end and a partially closed rear end with a first and second rear portions and a pair of ledge members disposed intermediate such first and second rear portions for enabling the draft gear assembly to fit into a draft gear pocket of a predetermined length. A first rear portion is adapted to receive a compressible cushioning element with a seating arrangement abutting one end thereof which extends longitudinally from the second portion of the closed rear end toward the open front portion. A removable bottom wall is attachable either to the first or second rear portions for enabling installation of the compressible cushioning element through the first end. The open front end is adapted to receive a friction cushioning means which has a spring release mechanism for continuously urging the friction cushioning means outwardly from the compressible cushioning element thereby releasing such friction cushioning means after compression of such draft gear assembly. The open front end is configured for direct attachment to a coupler with a coupler key.

20 Claims, 3 Drawing Sheets

FRICTION DRAFT GEAR HOUSING HAVING A REMOVABLE END WALL

CROSS-REFERENCE TO RELATED APPLICATIONS

This application is closely related to U.S. patent application Ser. No. 10/927,911, entitled "Housing For Long Travel High Capacity Friction Draft Gear", filed on Aug. 27, 2004, and to U.S. patent application Ser. No. 10/927,910, entitled "Long Travel High Capacity Friction Draft Gear Assembly", filed on Aug. 27, 2004, and to U.S. patent application Ser. No. 10/928,843, entitled "Long Buff Short Draft Travel Draft Gear For Use In A 24.625 Inch Pocket", filed on Aug. 27, 2004. These applications are assigned to the assignee of the present invention and the disclosures of these related applications are incorporated herein by reference thereto.

FIELD OF THE INVENTION

The present invention relates, in general, to friction-type draft gear assemblies for use in cushioning both buff and draft shocks normally encountered by railroad rolling stock during make-up and operation of a train consist on a track structure and, more particularly, this invention relates to a friction-type draft gear assembly having a higher capacity and a longer travel and, yet more particularly, the instant invention relates to a higher capacity long travel friction-type draft gear assembly having an integrated yoke.

BACKGROUND OF THE INVENTION

Friction-type draft gear assemblies are widely used in the railroad industry to provide protection to a railway car by absorbing shocks in both draft and buff conditions. They are installed in alignment with a railway car center sill having a pair of front stops and a pair of opposed rear stops that form a draft gear pocket. It is well known that various railroads now use a standard draft gear pocket of 24.62 inches in length. As a result, it has been mandated that friction-type draft gear assemblies of different designs must fit into such standard draft gear pocket.

It has been further mandated and accepted to provide a standard friction-type draft gear assembly for use with a 24.62 inch long pocket which is capable of 3.25 inch travel in buff and draft directions.

Such friction-type draft gears are installed in combination with a separate yoke and include a housing having an open front portion disposed adjacent a pair of front stops and a closed rear portion which engages a pair of rear stops. A compressible cushioning element is positioned within the rear portion of the housing. A friction cushioning element is disposed in the front portion of the housing.

The friction-type draft gears further includes a spring release mechanism for continuously urging the friction cushioning element outwardly from the compressible cushioning element thereby releasing such friction cushioning element after compression of such draft gears. The compressible cushioning element is typically either of an all coil spring configuration as taught in U.S. Pat. Nos. 5,152,409 and 5,590,797 or of a coil spring and hydraulic assembly combination as taught in U.S. Pat. No. 3,368,698.

Related patent applications teach another type of friction draft gear assembly that incorporates the yoke as an integral portion of the housing at the open end thereof.

The friction-type draft gear assembly with an integrated yoke has an advantage in that it fits into a smaller pocket and its adjacent areas in the freight railway car, or provides for a higher shock absorbing capacity and longer travel when installed into a standard 24.625 inch long pocket.

However, as it has been discovered in some applications, a major drawback of the friction-type draft gear assembly with the integrated yoke is that it will only accept a main coil spring of a smaller diameter as installation of such spring through the open yoke end is prevented by the opening in such yoke end, which is smaller than the diameter of the main coil spring. As is well known, the size of the opening is selected to cooperate with the coupler arm disposed therein and provides for a predetermined clearance therewith.

Such arrangement enables the coupler arm to move during motion of the railway car around a curve but does not enable the coupler arm to tilt thus imparting unwanted bending stresses onto a key connection of the coupler arm with the yoke. The bending stresses are particularly undesirable when the key is vertically disposed.

Therefore, it has been necessary to maintain the size of the yoke opening smaller than the size of the standard coil spring. Such smaller diameter of the coil spring, as was discovered, reduces an overall performance of the friction-type draft gear assembly with the integrated yoke as compared with a similar friction-type draft gear assembly without the integrated yoke. Attempts to compensate for such performance reduction by increasing the length of the coil spring did not achieve a desired result, as the overall performance was not sufficiently increased.

Therefore, it is desirable to provide a friction-type draft gear assembly with the integrated yoke incorporating the standard coil spring and achieving a higher shock absorbing capacity.

SUMMARY OF THE INVENTION

The present invention provides a friction draft gear assembly for railway car stock having a higher shock absorbing capacity. The friction draft gear assembly comprises a housing partially closed at a first end and open at an axially opposed second end. The first end includes a first rear portion and a smaller second rear portion outwardly extending therefrom which forms a pair of ledge members disposed intermediate the first and second rear portions for enabling the second rear portion to fit between a pair of rear stops. Utilization of the second rear portion enables the friction draft gear assembly to achieve a higher shock absorbing capacity and a longer travel in buff and draft directions. The first rear portion is adapted to receive a compressible cushioning element which extends longitudinally from the second rear portion toward the second open end. A removable end wall is attached to the second rear portion with a plurality of complimentary tapered edges for installation of the compressible cushioning element through the first end.

Alternatively, the removable end wall may be attached with a plurality of fasteners, rods or may be integrated into such second rear portion.

In an alternative embodiment, the first end of the housing comprises a first rear portion having a removable end wall directly attached thereto enabling the friction draft gear assembly to achieve the desired higher shock absorbing capacity. The second open end includes an integrated yoke portion having a coupler aperture for receiving a coupler arm, a pair of aligned apertures for attachment to a coupler of the railway car with a coupler key, and a pair of opposed coupler follower apertures. The cross-section of the coupler aperture is smaller than the cross-section of the compressible cushioning element causing installation thereof through the first end prior to attachment of the end wall. The second end at least partially receives a friction cushioning means for absorbing energy during a compression of such draft gear assembly and a spring release means engaging and longitudinally extending between a seat means and the friction cushioning means for continuously urging the friction cushioning means outwardly from the compressible cushioning means to release the draft gear when an applied force compressing such draft gear assembly is removed.

OBJECTS OF THE INVENTION

It is therefore one of the primary objects of the present invention is to provide a friction draft gear assembly having an integrated yoke which protects a railway car by absorbing shocks in both draft and buff conditions.

A further object of the present invention is to provide a friction draft gear assembly having an integrated yoke which achieves a higher shock absorbing capacity.

Yet a further object of the present invention is to provide a friction draft gear assembly having an integrated yoke which achieves a higher shock absorbing capacity and a longer travel distance.

Another object of the present invention is to provide a friction draft gear assembly having an integrated yoke which achieves a higher shock absorbing capacity and having a longer travel distance while fitting into a 24.625 inches long pocket.

An additional object of the present invention is to provide a friction draft gear assembly having an integrated yoke which incorporates a larger diameter coil spring.

These and various other objects and advantages to the present invention will become more apparent to those persons skilled in the relevant art from the following more detailed description, particularly, when such description is taken in conjunction with the attached drawings and the appended claims.

Figure 1:
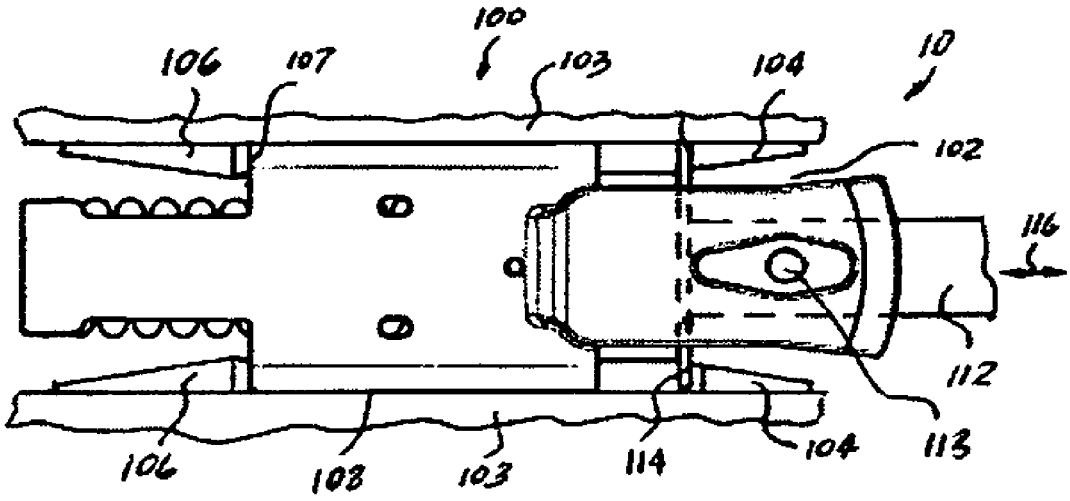
FIG. 1 is a plan view of a friction draft gear assembly of the present invention as installed into a railway car pocket, partially illustrated attached to a railway coupler.

DETAILED DESCRIPTION OF THE PRESENTLY PREFERRED AND ALTERNATIVE EMBODIMENTS OF THE INVENTION

Prior to proceeding to the more detailed description of the present invention, it should be noted that for the sake of clarity identical components, having identical functions have been identified with identical reference numerals throughout the several views, which have been illustrated in the drawing figures.

The present invention enables a friction draft gear assembly with an integrated yoke to achieve a higher shock absorbing capacity and a longer travel distance in buff and draft directions by employing a novel housing construction having a removable end wall, which enables installation of the compressible cushioning element through the first rear end.

Referring to the present invention, as shown in FIG. 1, a friction draft gear assembly, generally designated 10, is disposed within a cavity 102 of a center sill, generally designated 100, of a railway car which is not shown, but is well known in the art. A front stop 104 and an axially opposed rear stop 106 are attached to each side member 103 of the center sill 100 and form a draft gear pocket 108. Preferably, such draft gear pocket 108 has a first predetermined length of 24.625 inches.

A coupler arm 112 of a coupler (not shown) extends into the cavity 102 for attachment to the friction draft gear assembly 10 with a key 113. The coupler (not shown) is generally disposed along the longitudinal axis 116 of the center sill 100. A front coupler follower 114 is disposed intermediate the coupler arm 112 and the friction draft gear assembly 10 for evenly transmitting the shock from the coupler (not shown) thereto.

The friction draft gear assembly 10 includes a housing, generally designated 12, having a first partially closed end, generally designated 14, which is oriented toward the rear stops 106 and a second generally open end, generally designated 50, which is oriented toward the front stops 104.

The first partially closed end 14 includes a first rear portion 16 having a first predetermined cross-section and a second predetermined length and has an aperture 17 of a second predetermined cross-section being axially disposed within a first end thereof. An axially aligned second rear portion 18 having a third predetermined cross-section, which is smaller than the second predetermined cross-section of the first rear portion, and having a third predetermined length extends from the first end of the first rear portion 16.

The first end thus forms a pair of ledge members 20 having a predetermined width disposed intermediate the first and second rear portions 16 and 18 respectively and abutting working surfaces 107 of the pair of the rear stops 106. Such pair of ledge members 20 enables the second rear portion 18 of the first closed end to extend into such sill 100 past the working surface 107 of the rear stops 106. It will be appreciated that such second rear portion 18 will be at least partially disposed intermediate such rear stops 106.

In a presently preferred embodiment, the second rear portion 18 incorporates at least a pair of opposed surfaces 30 being, preferably, integral to the first rear portion 16 and axially and outwardly extending from the first end thereof.

An end wall 22 having an inner surface 23 is detachably attached to such second rear portion 18 and in combination with such at least a pair of opposed surfaces 30 partially close such first end 14.

Preferably, each surface 30 has a pair of ledge members 32 inwardly extending therefrom and which are truncated at a first predetermined distance 34 from the inner surface 23 of the end wall 22. In the presently preferred embodiment, best shown in FIGS. 2-5, attachment of the end wall 22 to the surface portions 30 is achieved with a pair of edges 26 mating with a pair of edges 36, each of which is disposed within the outer end 38 of the surface portion 30.

Figure 2:
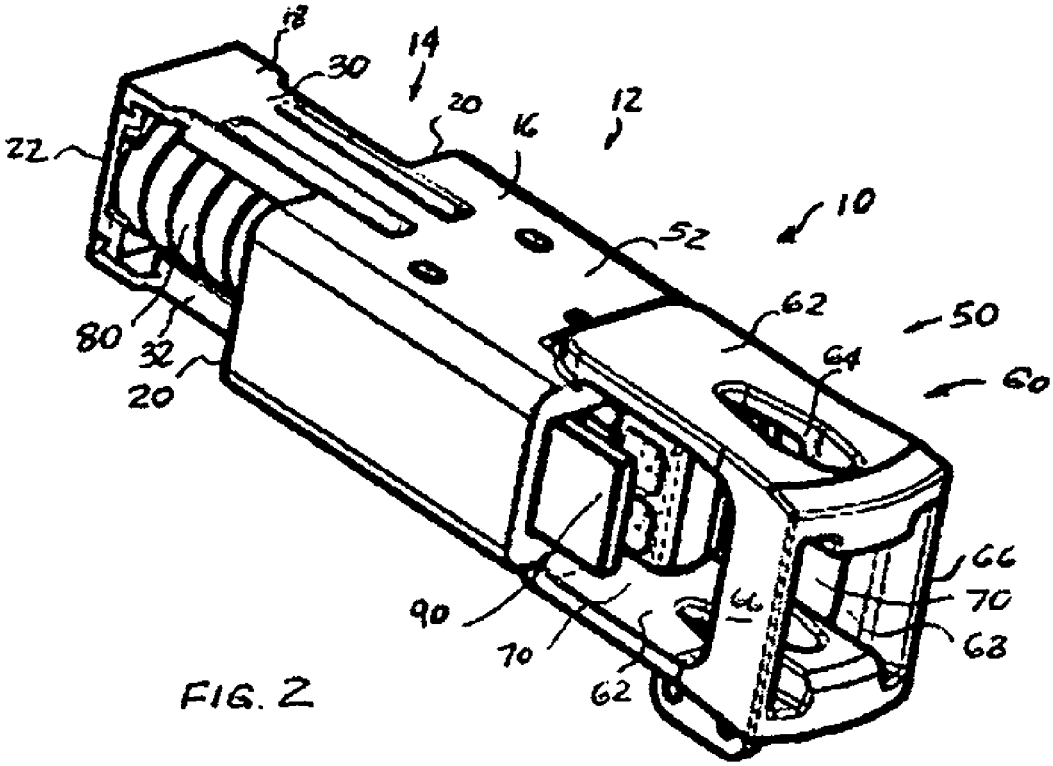
FIG. 2 is a perspective view of the friction draft gear assembly of the present invention.
Figure 3:
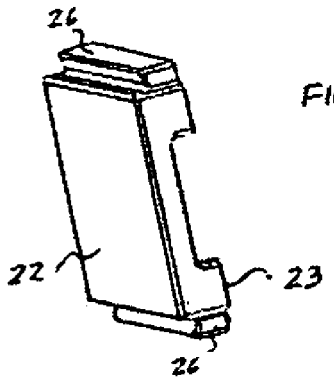
FIG. 3 is a perspective view of the friction draft gear assembly showing a rear end wall of a presently preferred embodiment of the invention.
Figure 4:
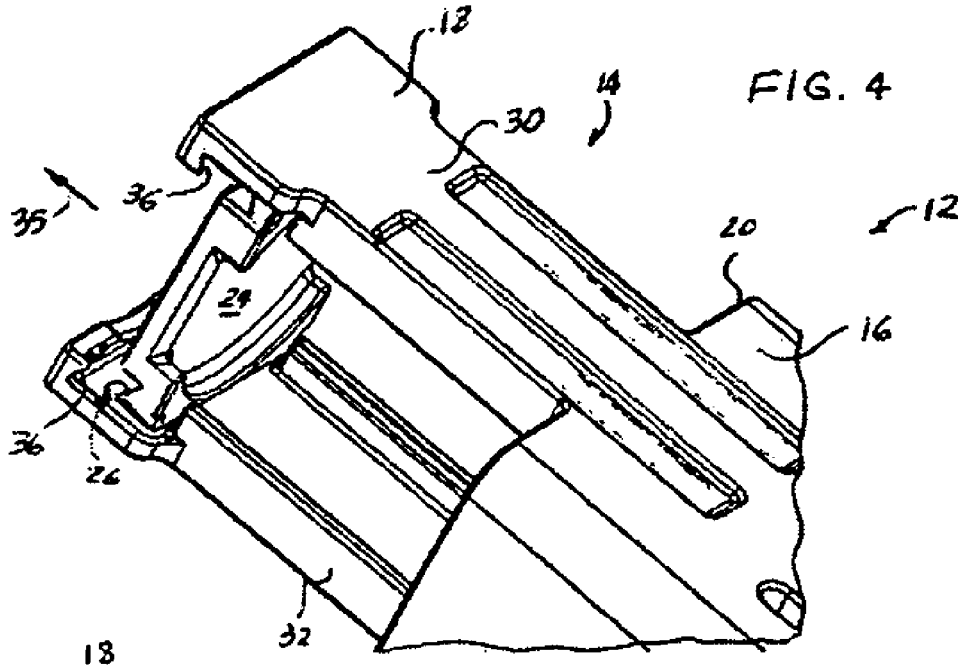
FIG. 4.*is* a partial perspective view of the friction draft gear assembly of the present invention showing installation of the rear end wall of the presently preferred embodiment.
Figure 5:
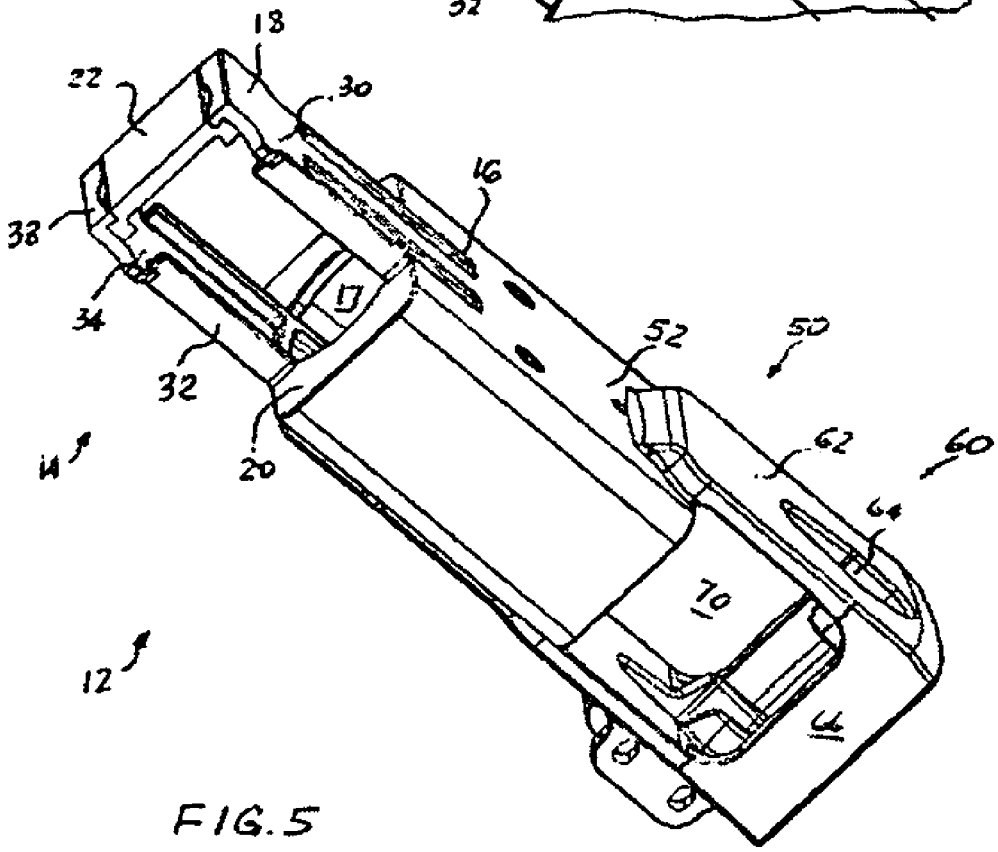
FIG. 5 is a perspective view of the friction draft gear assembly of the present invention showing the rear end wall of the presently preferred embodiment in an installed position.

In particular reference to FIG. 4, the end wall 22 is first inserted into the second rear portion 18 through the opening formed by the first predetermined distance 34 and then is axially moved in a direction 35 enabling mating of the first and second pair of edges 26 and 36, respectively, as best shown in FIGS. 2 and 5.

Preferably, such first and second pair of edges 26 and 36, respectively, are tapered for preventing outward movement of the surfaces 30 during operation of the friction draft gear assembly 10.

Figure 6:
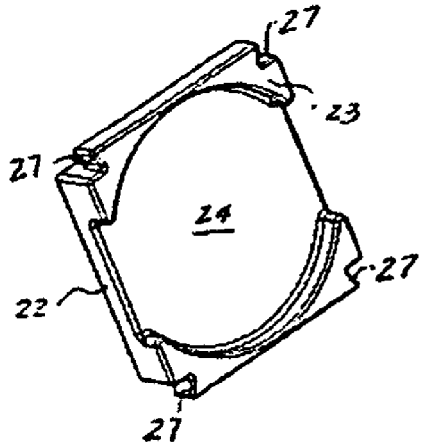
FIG. 6 is a perspective view of the friction draft gear assembly of the present invention showing the rear end wall of an alternative embodiment of the present invention.

In an alternative embodiment, shown in FIG. 6, such attachment of the end wall 22 is achieved with a plurality of corners 27 mating with a plurality of corners disposed within the surface portions 30. Preferably, at least a pair of corners 27 are tapered.

Figure 7:
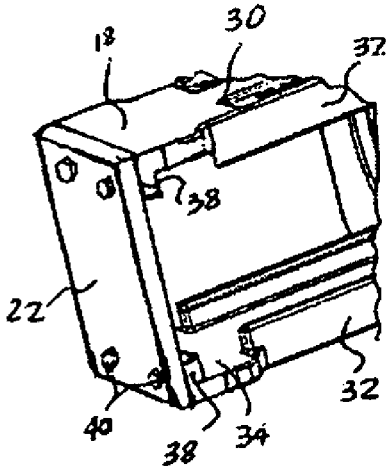
FIG. 7 is a partial perspective view of the friction draft gear assembly of the present invention showing a first alternative attachment of the rear end wall.

In another alternative embodiment, shown in FIG. 7, each outer edge 38 is adapted for receiving at least one, and preferably a pair of fasteners 40 of threaded and non-threaded types.

Figure 8:
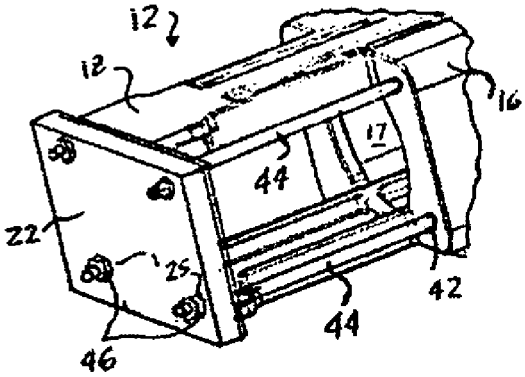
FIG. 8 is a partial perspective view of the friction draft gear assembly of the present invention showing a second alternative attachment of the rear end wall.

In yet another alternative embodiment, shown in FIG. 8, the end wall 22 is attached with a plurality of rods 44, each of such rods 44 having a first threaded end engaging a threaded cavity 42 respectively disposed within the first end of the first rear portion 16 and having a second end extending through an aperture 25 respectively aligned in the end wall 22 and adapted for receiving a threaded fastener 46.

It will be appreciated that a cross-section of a portion of at least a pair of rods 44 disposed intermediate the first end of the first rear portion 16 and the inner surface 23 of the end wall 22 may be enlarged to overlap such threaded cavity 42 and an aperture 25 thus maintaining the end wall 22 at a second predetermined distance from the first rear portion 16 and, more particularly, eliminating the need for surface portions 30 of the second rear portion 18.

Figure 9:
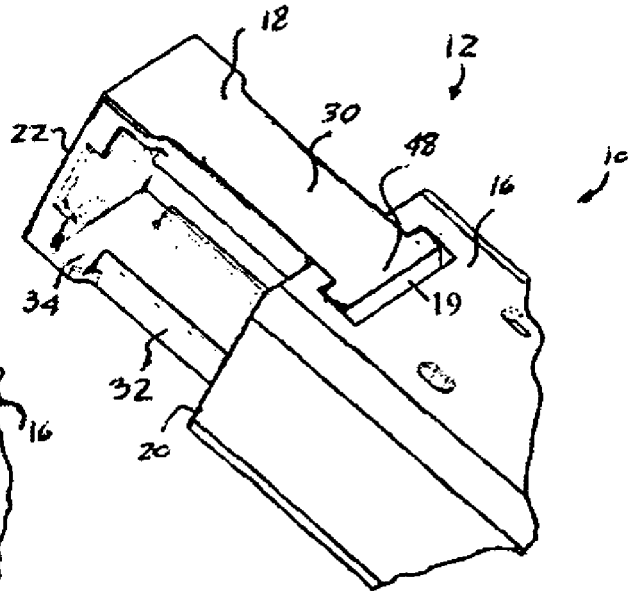
FIG. 9 partial perspective view of the friction draft gear assembly of the present invention showing a third alternative attachment of the rear end wall.

In a further alternative embodiment of the present invention, shown in FIG. 9, the end wall 22 may be integral to each surface portion 22 thus forming an integral second portion 18 attachable to the first rear portion 16 with a flanged ends 48 engaging respective apertures 19 disposed within the first rear portion 16 or alternatively attachable with a predetermined plurality of rods 44 as best shown in FIG. 8.

The second end 50, best shown in FIGS. 2 and 5, is axially opposed to the first partially closed end 14 and is maintained in open communication therewith. Such second end 50 has a first front portion 52 of a fourth predetermined cross-section and a fourth predetermined length disposed adjacent the first rear portion 16 and has a second front portion, generally designated 60, outwardly extending toward the pair of front stops 104 and adapted for engagement with the coupler arm 112.

Preferably, such fourth predetermined cross-section of the first front portion 52 is equal to the first predetermined cross-section of the first rear portion 16.

It will be appreciated that such second front portion 60 is configured as an integral yoke portion which includes a pair of opposed surfaces 62 having a coupler key apertures 64 disposed therein and preferably having a pair of opposed supports 66 disposed generally perpendicular to such surfaces 62 and joining such surfaces 62 at outer ends thereof. Such combination of opposed surfaces 62 and opposed supports 66 form a coupler arm aperture 68 of a fifth predetermined cross-section and a pair of opposed coupler follower apertures 70.

Such fifth predetermined cross-section of the coupler arm aperture 68 provides a predetermined clearance with the coupler arm 112 extending therethrough enabling the coupler arm 112 to move during a motion of the railway car (not shown) around a curve but prevents the coupler arm 112 tilting and impart unwanted bending stresses onto a coupler key 113.

In further reference to FIG. 2, the first end 14 is adapted for receiving therein a compressible cushioning element 80 which has one end thereof positioned within a cavity 24 formed in the inner surface 23 of the end wall 22. Preferably, such compressible cushioning element 80 is a resilient compression means 80 being at least one spring element having a sixth predetermined cross-section and having the other end extending into the first rear portion 16 through the aperture 17 and abutting a well known spring seat means (not shown) adapted within the housing 12 for longitudinal movement therein for respectively compressing and releasing the compressible cushioning element 80 during application and release of a force on the friction draft gear assembly 10.

In the present invention, such sixth predetermined cross-section of the at least one spring element 80 is greater than the fifth predetermined cross-section of the coupler arm aperture 68.

The spring seat means (not shown) and the positioning cavity 24 maintain axial alignment of the at least one spring element 80 within the draft gear housing 12. Alternatively or additionally, the positioning and alignment of the at least one spring element 80 may be maintained by the plurality of longitudinal ledge members 32.

Furthermore, the second predetermined cross-section of the aperture 17 of the first end 14 is greater than such sixth predetermined cross-section of the spring element 80.

The second end 50 is adapted for receiving a friction cushioning means 90 at least partially disposed within the first front portion 52 for absorbing energy during application of the force sufficient to cause a compression of the friction draft gear assembly 10.

A spring release means (not shown) engaging and longitudinally extending between the seat means (not shown) and the friction cushioning means 90 are disposed within the housing 12 for continuously urging the friction cushioning means 90 outwardly from the compressible cushioning element 80 to release it when an applied force compressing such friction draft gear assembly 10 is removed.

To assemble the friction draft gear 10, the at least one spring element 80 is first inserted into the first rear portion 16 through the aperture 17 in a direction of the second end 50. Secondly, the end wall 22 or the second rear portion 18 is attached according to the various embodiments described supra. The at least one spring element 80 is then moved to abut the end wall 22 and compressed enabling insertion and assembly of the seat means (not shown), spring release means (not shown) and friction cushioning means 90 through the second end 50.

Such assembly method enables utilization of the spring element 80 presently in use with friction draft gear assemblies without an integrated yoke enabling the friction draft gear assembly 10 of the present invention to achieve a higher shock absorbing capacity in combination with a longer travel distance in buff and draft conditions.

Those skilled in the art will readily understand that a removable end wall 22 may be used with a housing 12 having only such first rear portion 16 and having an integrated front yoke portion 60 to achieve higher shock absorbing capacity only. In such application, the end wall 22 will be attached to the first end of the first rear portion 16 according to the various embodiments described supra. Such embodiment will provide for a modular structure of the first end 14 enabling ease of interchangeability between standard and long travels in buff and draft conditions.

Those skilled in the art will further understand that the end wall 22 may be extended to cover the entire first end 14 and abut the working surfaces 107 of the rear stops 106.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

We claim:

1. A housing for a railway car friction-type draft gear assembly for cushioning buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly disposed within a center sill of such railway car between a pair of front stops and an axially opposed pair of rear stops which are attached to such center sill, said housing comprising:

(a) a first end having a predetermined cross-section and a predetermined length and having a portion thereof abutting such pair of rear stops;

(b) an end wall engageable with and releaseably secured to said first end and abutting one end of a compressible cushioning element of such friction-type draft gear assembly;

(c) a means engageable with said end wall and said first end for securing said end wall thereto; and (d) a second end having a first front portion of a predetermined cross-section and a predetermined length being disposed adjacent said first end and a second front portion extending outwardly from said first front portion and having a pair of first aligned apertures for attachment to such coupler with a coupler key, said second end being axially opposed to said first end and further being in open communication therewith.

2. A housing according to claim 1, wherein said housing includes a positioning means engageable with an inner surface of said end wall for centrally maintaining one end of a compressible cushioning element disposed in said first end during compression and extension of said compressible cushioning element, said compressible cushioning element extending longitudinally from said inner surface of said end wall into said first rear portion of said first end.

3. A housing according to claim 2, wherein said compressible cushioning element includes at least one resilient compression means having a sixth predetermined cross-section.

4. A housing according to claim 3, wherein said at least one resilient compression means is at least one of a spring element, hydraulic assembly, elastomeric pad stack, and combination thereof.

5. A housing according to claim 2, wherein said first end receives a seat means having at least a portion of one surface thereof abutting an axially-opposite end of said compressible cushioning element and mounted to move longitudinally within said housing for respectively compressing and releasing said compressible cushioning element during application and release of a force exerted on such draft gear assembly.

6. A housing according to claim 1, wherein said attachment means includes a predetermined plurality of first edges disposed within said end wall and mating with a complimentary plurality of second edges disposed within said first end, said first end having at least one aperture for inserting said end wall thereinto.

7. A housing according to claim 6, wherein said predetermined plurality of first and second edges are tapered.

8. A housing according to claim 1, wherein said attachment means includes a predetermined plurality of first corners disposed within said end wall and mating with a complimentary plurality of second corners disposed within said first end, said first end having said at least one aperture for inserting said end wall thereinto.

9. A housing according to claim 8, wherein said predetermined plurality of first and second corners are tapered.

10. A housing according to claim 1, wherein said attachment means includes said end wall having a pair of flanged ends engaging complimentary apertures disposed within said first end.

11. A housing according to claim 1, wherein said second front portion includes a pair of first opposed surfaces and a pair of second opposed surfaces forming an axially disposed second aperture having a predetermined cross-section for receiving a coupler arm and forming a pair of opposed apertures for receiving a coupler follower.

12. A housing according to claim 1, wherein said second end receives a friction cushioning means for absorbing energy during a compression of such draft gear assembly and a spring release means engaging and longitudinally extending between said seat means and said friction cushioning means for continuously urging said friction cushioning means outwardly from said compressible cushioning element to release said friction cushioning means when an applied force compressing such draft gear assembly is removed.

13. A housing for a railway car friction-type draft gear assembly for cushioning buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly disposed within a center sill of such railway car between a pair of front stops and an axially opposed pair of rear stops which are attached to such center sill, said housing comprising:

(a) a first end including a first rear portion having a predetermined cross-section and a predetermined length and having an aperture of a predetermined cross-section being axially disposed within a first end thereof and a second rear portion having at least a pair of opposed surface members having a predetermined length and forming a predetermined cross-section of said second rear portion, said second rear portion is axially aligned with said first rear portion, said predetermined cross-section of said second rear portion being generally smaller than said predetermined cross-section of said first rear portion;

(b) a pair of rear ledge members having a predetermined width disposed intermediate said first and second rear portions and abutting a working surface of each of such rear stops, whereby said pair of rear ledge members enables said second rear portion of said first end to extend into such sill intermediate such pair of rear stops past said working surfaces thereof;

(c) an end wall engageable with and releaseably secured to one of said first rear portion, said second rear portion and a combination thereof, said end wall abutting one end of a compressible cushioning element of such friction-type draft gear assembly;

(d) a means disposed within said first end for removably securing said end wall to one of said first rear portion, said second rear portion and said combination thereof; and (e) a second end having a first front portion of a predetermined cross-section and a predetermined length being disposed adjacent said first rear portion of said first end and a second front portion extending outwardly from said first front portion and having a pair of first aligned apertures for attachment to such coupler with a coupler key, said second end being axially opposed to said first end and further being in open communication with said first rear portion thereof.

14. A housing according to claim 13, wherein said first end includes a positioning means disposed within an inner surface of said end wall for centrally maintaining one end of a compressible cushioning element disposed in said second portion of said first end during compression and extension of said compressible cushioning element, said compressible cushioning element extending longitudinally from said inner surface of said end wall into said first rear portion of said first end.

15. A housing according to claim 14, wherein said compressible cushioning element includes at least one resilient compression means, said compressible cushioning element having a sixth predetermined cross-section.

16. A housing according to claim 14, wherein said first rear portion of said first end is adapted to receive a seat means having at least a portion of one surface thereof abutting an axially-opposite end of said compressible cushioning element and mounted to move longitudinally within said housing for respectively compressing and releasing said compressible cushioning element during application and release of a force exerted on such draft gear assembly.

17. A housing according to claim 16, wherein said predetermined cross-section of said first front portion is equal to said predetermined cross-section of said first rear portion.

18. A housing according to claim 13, wherein said second end receives a friction cushioning means for absorbing energy during a compression of such draft gear assembly and a spring release means engaging and longitudinally extending between said seat means and said friction cushioning means for continuously urging said friction cushioning means outwardly from said compressible cushioning element to release said friction cushioning means when an applied force compressing such draft gear assembly is removed.

19. A housing for a railway car friction-type draft gear assembly which enables cushioning of buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly disposed within a center sill of such railway car between a pair of front stops and an axially opposed pair of rear stops which are attached to such center sill, said housing comprising:

(a) a first end having a first predetermined cross-section and a second predetermined length and having an aperture of a second predetermined cross-section axially disposed therein;

(b) a pair of rear ledge members formed within said first end and abutting a working surface of each of such rear stops, said pair of rear ledge members having a first predetermined width;

(c) an end wall engageable with and releaseably secured to said first end for at least partially covering said aperture, said end wall abutting one end of a compressible cushioning element of such friction-type draft gear assembly;

(d) a means engageable with said end wall and said first end for releaseably securing said end wall thereto; and (e) a second end having a first front portion of a fourth predetermined cross-section and a fourth predetermined length being disposed adjacent said first end and a second front portion extending outwardly from said first front portion and having a pair of first aligned apertures for attachment to such coupler with a coupler key, said second end being axially opposed to said first end and further being in open communication therewith.

20. A housing for a railway car friction-type draft gear assembly which enables cushioning of buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly disposed within a center sill of such railway car between a pair of front stops and an axially opposed pair of rear stops which are attached to such center sill, said housing comprising:

(a) a first end having a first predetermined cross-section and a second predetermined length and having an aperture of a second predetermined cross-section axially disposed therein;

(b) an end wall engageable with and releaseably secured to said first end with predetermined plurality of rod members, wherein each of said predetermined plurality of rod members having a first threaded end thereof engaging a threaded cavity respectively aligned within said first end adjacent said aperture and has a second end thereof extending through an aperture respectively aligned in said end wall, said second threaded end is for receiving a threaded fastener, wherein at least a pair of said predetermined plurality of said rod members includes a portion thereof disposed intermediate said inner surface of said end wall and said first end having a predetermined cross-section overlapping said aperture of said end wall and said threaded cavity of said first rear portion for maintaining said end wall at a first predetermined distance from said first rear portion, whereby said predetermined plurality of rod members forms an extension of said first end having a third predetermined cross-section, said third predetermined cross-section being smaller than said first predetermined cross-section, said removable end wall abutting one end of a compressible cushioning element of such friction-type draft gear assembly;

(c) a pair of rear ledge members formed within said first end and abutting a working surface of each of such rear stops, said pair of rear ledge members having a first predetermined width; and (d) a second end having a first front portion of a fourth predetermined cross-section and a fourth predetermined length being disposed adjacent said first rear portion of said first end and a second front portion extending outwardly from said first front portion and having a pair of first aligned apertures for attachment to such coupler with a coupler key, said second end being axially opposed to said first end and further being in open communication with said first rear portion thereof.

* * * * *